US006886182B2

(12) United States Patent
Saillet et al.

(10) Patent No.: US 6,886,182 B2
(45) Date of Patent: May 3, 2005

(54) WATER SPORTS GARMENT HAVING A MULTI-LAYERED ZONE

(75) Inventors: Benoît Saillet, Albens (FR); Pascal Vergne, Vieux Boucau (FR)

(73) Assignee: Salomon S.A., Metz-Tessy (FR)

( * ) Notice: Subject to any disclaimer, the term of this patent is extended or adjusted under 35 U.S.C. 154(b) by 316 days.

(21) Appl. No.: 10/083,580

(22) Filed: Feb. 27, 2002

(65) Prior Publication Data

US 2002/0116740 A1 Aug. 29, 2002

(30) Foreign Application Priority Data

Feb. 28, 2001 (FR) ..... 01 02926

(51) Int. Cl.[7] ..... B63C 11/04

(52) U.S. Cl. ..... 2/2.16; 2/2.13; 2/2.15; 2/2.17

(58) Field of Search ..... 2/2.13, 2.15, 2.16, 2/2.17

(56) References Cited

U.S. PATENT DOCUMENTS

| | | | | | |
|---|---|---|---|---|---|
| 4,293,957 | A | * | 10/1981 | Melarvie | 2/2.17 |
| 5,086,920 | A | * | 2/1992 | Binienda | 206/335 |
| 5,787,502 | A | * | 8/1998 | Middleton | 2/69 |
| 5,802,609 | A | * | 9/1998 | Garofalo | 2/2.17 |
| 5,806,090 | A | * | 9/1998 | Johnson | 2/2.15 |
| 5,896,578 | A | * | 4/1999 | Hunter et al. | 2/2.15 |
| 5,898,934 | A | * | 5/1999 | Hunter et al. | 2/2.15 |
| 6,223,349 | B1 | * | 5/2001 | Roiser | 2/2.17 |
| 6,415,449 | B2 | * | 7/2002 | Duplock | 2/275 |
| 6,434,749 | B1 | * | 8/2002 | Grounds et al. | 2/2.15 |
| 6,473,904 | B2 | * | 11/2002 | Long | 2/2.15 |

FOREIGN PATENT DOCUMENTS

| | | |
|---|---|---|
| DE | 2339924 | 2/1975 |
| FR | 2625078 | 6/1989 |
| GB | 974426 | 11/1964 |
| JP | 60-231804 | 11/1985 |

OTHER PUBLICATIONS

Database WPI, Section Ch, Week 198601, Derwent Publications Ltd., London, Great Britain, AN 1986–004402, XP–002183897.

* cited by examiner

*Primary Examiner*—Danny Worrell
*Assistant Examiner*—Robert H. Muromoto, Jr.
(74) *Attorney, Agent, or Firm*—Greenblum & Bernstein, P.L.C.

(57) ABSTRACT

An aquatic sports garment having an outer layer, provided with at least one multi-layered zone including at least the outer layer and an underlying layer which, in a protective zone, lines the skin in an elastically deformable manner so as to protect it from contact with the outer layer, in that the underlying layer has a fixing zone, whereby it is fixed directly or indirectly to the outer layer, and wherein, at least in the protective zone, the two layers are free from one another.

36 Claims, 3 Drawing Sheets

WATER SPORTS GARMENT HAVING A MULTI-LAYERED ZONE

CROSS-REFERENCE TO RELATED APPLICATION

This application is based upon French Patent Application No. 01 02926, filed Feb. 28, 2001, the disclosure of which is hereby incorporated by reference thereto, and the priority of which is hereby claimed under 35 U.S.C. §119.

BACKGROUND OF THE INVENTION

1. Field of the Invention

The present invention relates to an improvement to aquatic sports garments, such as a wetsuit, or such as a diving suit, water surfing suit, sailboarding jacket, etc.

Such a garment can also be used for other sporting activities, such as wakeboarding, for example. Rather than a suit, this can also be a two-piece garment, which include pants and a jacket.

2. Description of Background and Relevant Information

Such known garments, which must insulate the body from the cold, especially during the immersion phase, are generally made of a watertight, elastically deformable but thick material, generally neoprene.

Whether it is an underwater diver, or a surfer who is swimming from the top of his board to get an offing or yet to position himself on top of a wave, or an athlete on his sailboard, all of the joints of the body are stressed during movements, in particular in the area of the arms and legs.

With respect to the arms, a rotation about the shoulder joint occurs during swimming, or with respect to the knees, a bending also occurs in the kneecap area.

The garments of this type are generally snugly fitted, but a small amount of room is necessary in the area of the joints to enable necessary movement, especially as the material used is very thick. An adjustment that would enable the material to line the skin precisely (and constantly) is not possible due to the thickness of the material, even if it is substantially elastic. As a result, chafing and irritation occur, especially in the area of the athlete's joints, such as elbows, knees, shoulders and crotch, due to the friction in these zones of the garment on these parts of the body. To avoid these drawbacks, it has already been proposed to provide flexible zones in the area of the armpits to allow for easier movements. It is also known to provide a sealing gusset on the entire rear zone. However, in either case, this does not avoid the direct rubbing on the user's skin during certain movements.

Athletes sometime use a more or less snugly fitting thin undergarment to limit the drawbacks, but this makes the preparation even more time consuming, and properly superimposing the garment on the undergarment is a delicate undertaking.

SUMMARY OF THE INVENTION

An object of the present invention is to remedy the aforementioned drawbacks and, to this end, it relates to an improvement to an aquatic sports garment having an outer layer, wherein it has at least one multi-layered zone, including at least an outer layer and an underlying layer which, in a protective zone, lines the skin in an elastically deformable manner so as to protect the skin from contact with the outer layer, wherein the underlying layer includes a fixing zone whereby it is fixed directly or indirectly to the outer layer, and wherein, at least in the protective zone, the two layers are free from one another.

The present invention also relates to the characteristics which will become apparent from the description that follows, and which should be considered separately or according to all of their possible technical combinations.

BRIEF DESCRIPTION OF DRAWINGS

This description, provided by way of a non-limiting example, will help to better understand how the invention can be embodied, with reference to the annexed drawings, in which.

DETAILED DESCRIPTION OF THE INVENTION

Figure 1:
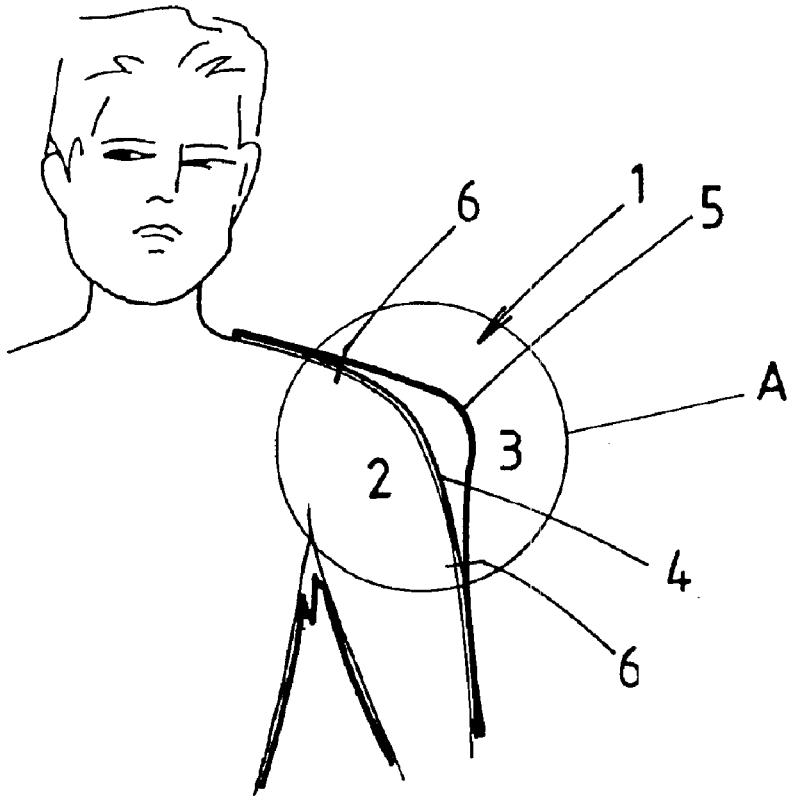
FIG. 1 is a schematic view of a portion of a water sports garment, in the area of a user's shoulder.

The water sports garment generally designated by the reference numeral 1 in FIG. 1 is a suit whose outer layer 5 is made, for example, of a neoprene layer, about 3 millimeters to about 8 millimeters thick. This outer layer can be covered on its outer surface with a woven jersey.

According to the invention, this garment includes, opposite to at least one part of a user's body, in this case opposite a joint such as a shoulder 2, a corresponding zone 3 in which the outer layer 5 is lined with a very flexible and very elastic underlying layer 4 that is adapted to almost constantly come into contact with the user's skin.

In this case, the two shoulders of the suit are involved, as could be the knees and elbows. Other portions of the suit could also be provided with an underlying layer in the context of the invention, in particular the end portions of the limbs of the suit, such as the wrists or ankles, or the neckline.

This underlying layer 4 has comfort characteristics and lines the user's skin in an elastically deformable manner so as to protect it from the contact with the other outer layer 5. The latter preferably has strength, insulation and watertightness properties, and forms, together with the underlying layer 4, the aforementioned multi-layered zone 3.

According to the invention, the underlying layer 4 is affixed to the suit, i.e., it is fixed directly or indirectly on the outer layer 5. Direct fixing means that the underlying layer can be fixed on an intermediary piece inserted between the underlying layer and the outer layer. However, this fixing must be efficient so that the underlying layer 4 is definitely opposite the part of the user's body which one wishes to protect more particularly, without the user having to worry about it when he puts on the suit, and that never forms a fold.

Figure 3:
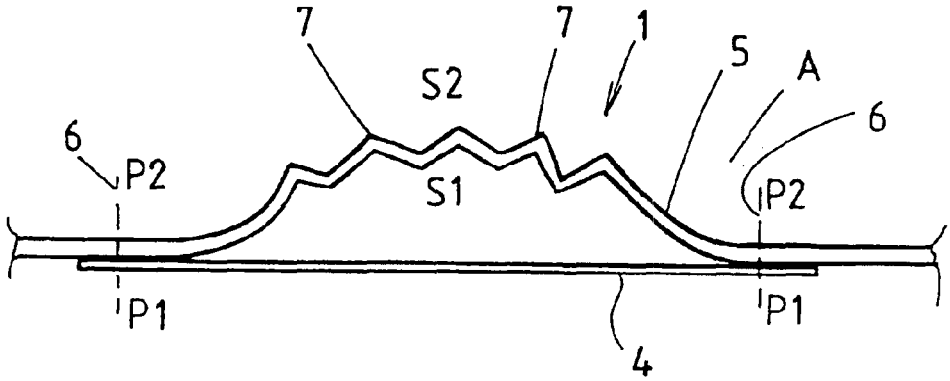
FIG. 3 is a detailed, enlarged view of the zone A according to FIG. 1, in a flat position.
Figure 4:
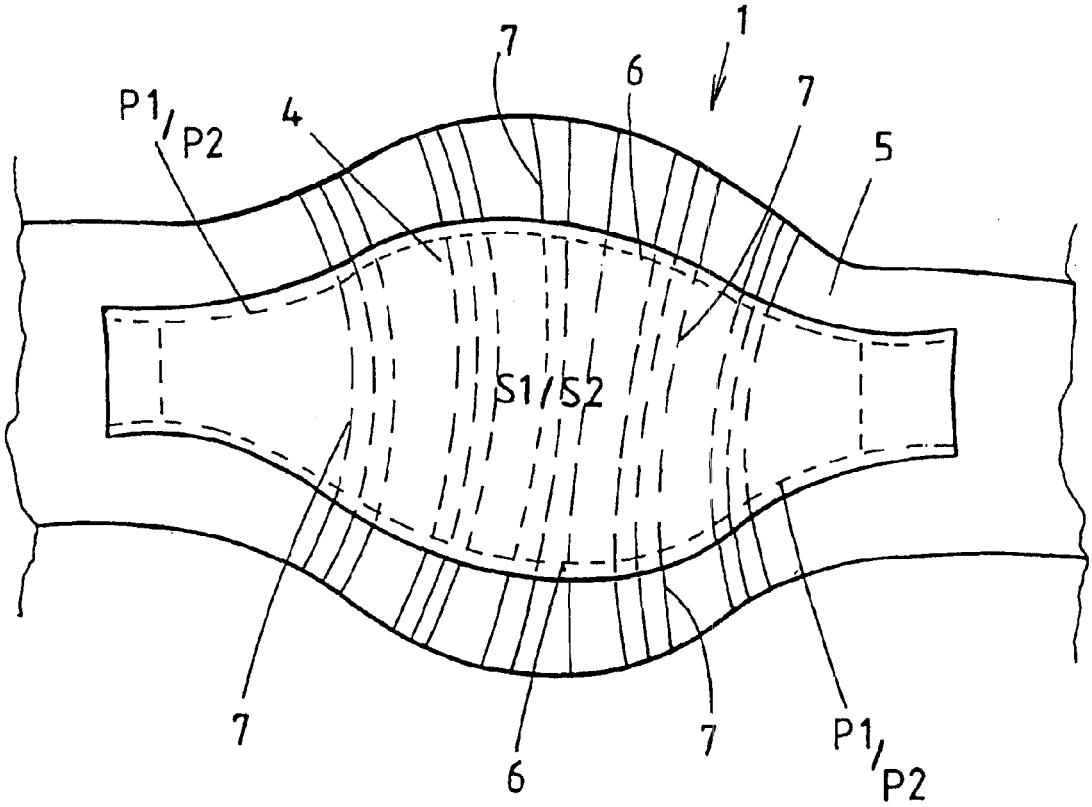
FIG. 4 is a bottom view according to FIG. 3.

In the embodiment of FIGS. 3 and 4, the zone for fixing the underlying layer 4 is constituted by its peripheral edge 6. In the area of this peripheral edge, the underlying layer 4 is fixed directly on the inner surface of the outer layer 5.

Figure 2:
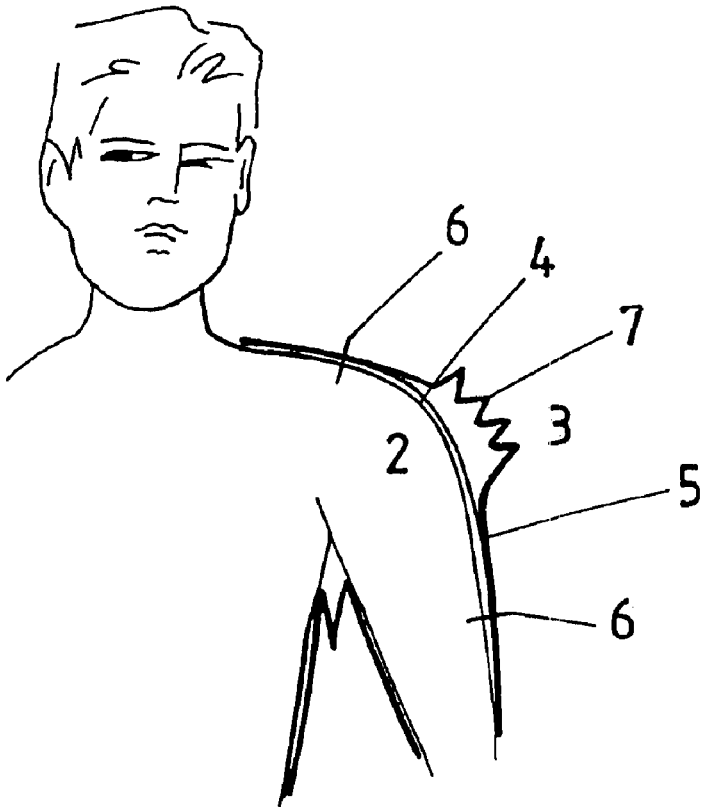
FIG. 2 is a schematic view of a portion of a garment, in the area of a user's shoulder according to an alternative embodiment.

Within the perimeter demarcated by the peripheral edge, the underlying layer thus includes a protective zone that is free with respect to the outer layer 5. This means in particular that the protective zone can move in relation to the corresponding zone of the outer layer 5, and vice versa. In the area of its protective zone, the outer layer 5 can be separated from the underlying layer 4 as shown in FIGS. 1, 2, and 3. Similarly, the outer layer 5 can move laterally in relation to the protective zone of the underlying layer 4. Thus, the outer layer 5 can move along with the user's movements without the underlying layer 4 sliding on the user's skin, which avoids chafing and irritations.

In the example of embodiment of FIGS. 3 and 4, the perimeter P1 of the inner layer 4 forming the fixing zone is substantially identical to the perimeter P2 of the outer layer 5 along which the two layers are fixed to one another. Stated another way, in the area of the protective zone of the underlying layer 4, i.e., within the area defined by the perimeter P1, there is but 2 single free zone by which the underlying layer 4 is non-attached to the outer layer 5. In addition, the development surface S2 of the bending zone demarcated within the perimeter P2 is larger than the development surface S1 of the underlying layer 4 forming the protective zone, especially as, due to the highly elastic material of the underlying layer, this surface S1 tends to be reduced to a minimum surface. A looseness of the outer layer 5 with respect to the underlying layer 4 is thus created to facilitate movement while eliminating the constraints on the user's skin.

In fact, the outer layer 5 is constituted by the watertight and elastically deformable material itself of the garment 1, whereas the underlying layer 4 is a yoke attached within the garment.

To achieve an object of the invention, the yoke constituting the underlying layer 4 is made from a thin, elastic and non-folding material, so that it lays flat against the user's skin in order to protect it when the garment 1 is worn by the user, and to accompany all of his movements. FIG. 3 shows the thin underlying layer 4 as being thinner than the outer layer 5 and, with the elasticity of the underlying layer 4, it is shown in FIG. 3 as extending flat beneath the foldable and heavier neoprene-based outer layer 5.

Advantageously, the material constituting the yoke 4 is of the Lycra type (a trademark registered and marketed by Dupont De Nemours Corporation).

The yoke constituting the underlying layer 4 is fixed on the outer layer 5, along its peripheral edge 6, by heat sealing, sewing, or with an adhesive.

The constituent material of the outer layer 5, as well as the remainder of the garment, is preferably constituted by neoprene or jersey associated with neoprene.

According to the alternative embodiment shown in FIGS. 2–4, the bending zone of the outer layer 5 includes, within the perimeter P2, functional folds 7 made by a previous thermoforming operation to procure more ease when they spread during a movement.

According to the invention, a garment 1 adapted to water sports advantageously includes multi-layered zones 3 at the elbows and/or knees and/or shoulders and/or crotch. When the multi-layered zones are arranged in the area of a joint, it is advantageous that the outer layer, which is the most rigid, have a certain fullness or looseness. In the other cases, the outer layer and the underlying layer can be applied against one another, without the outer layer having any fullness or looseness as described previously, but the construction according to the invention still enables the two layers to move parallel to one another, thus enabling the outer layer to follow the movements of the body and the underlying layer to stick to the skin to avoid any rubbing.

In the examples shown in FIGS. 1–4, the yoke 4 that constitutes the underlying layer is arranged so as to correspond to the upper portion of the user's shoulder, i.e., the convex portion of this joint. For this, it suffices to use a substantially planar yoke whose deformability enables it to assume the shape of the upper portion of the shoulder.

Figure 5:
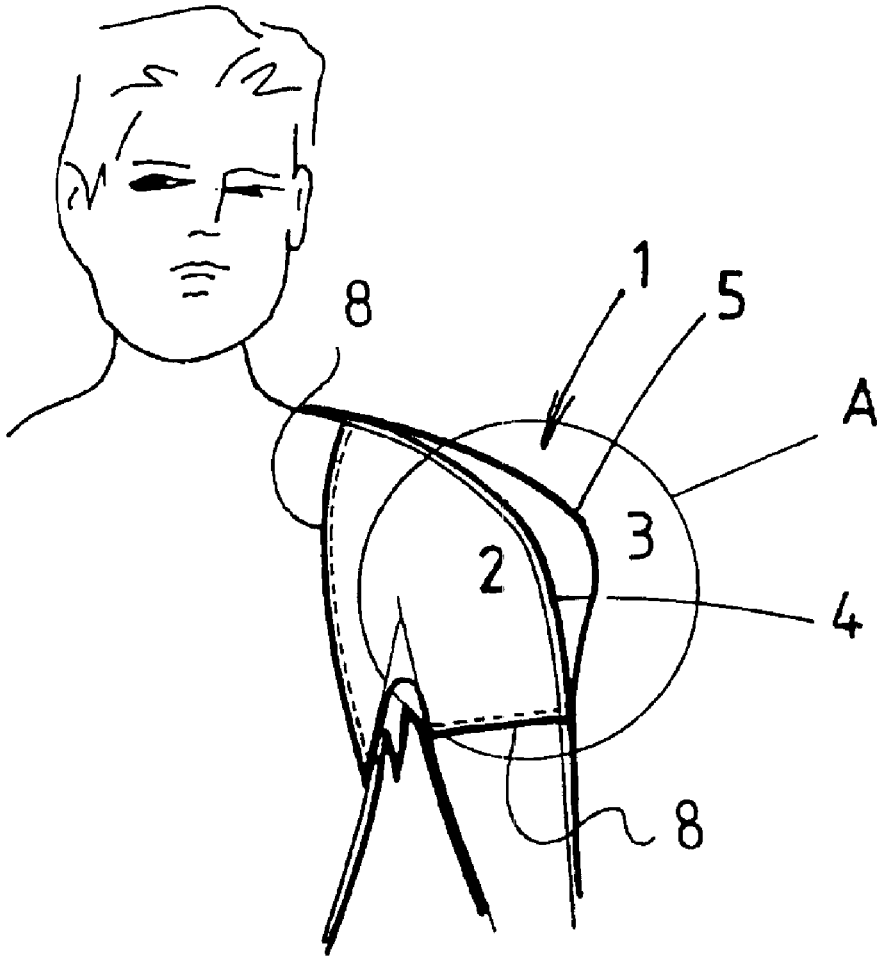
FIG. 5 is a view similar to those of FIGS. 1 and 2 showing another alternative embodiment of the invention.

In the alternative embodiment shown in FIG. 5, the yoke 4 is tubular and forms a sleeve through which the user inserts his arm so that the sleeve surrounds the entire shoulder in order to protect not only the top of the shoulder, but also the user's armpit. The sleeve 4 is fixed on the inner surface of the outer layer 5 of the suit by its two end edges 8. One of the edges 8 is therefore fixed on the inner surface of the outer layer of the sleeve of the suit, whereas the other edge 8 is fixed on the inner surface of the pectoral and dorsal torso portions of the suit. The form of this sleeve, when free, before it is fixed on the outer layer of the suit, can be that of a revolving cylindrical tube, or it can be a more complex form, such as a form flared in the area of one of the edges 8.

To enable the user's movements, the form of the outer layer 5 can be provided to be sufficiently loose, or the material of the outer layer can be sufficiently flexible and elastic.

Preferably, the end edges 8 of the sleeve 4 are assembled to the outer layer by heat sealing or gluing.

In the examples shown, the underlying layer or layers of the garment are obtained in the form of individual yokes. However, in the case of a suit having a plurality of distinct multi-layered zones, one can provide to obtain a plurality of multi-layered zones, in the context of the invention, by means of a single yoke. This yoke would then have large fixing zones on the inner surface of the outer layer and, in various locations, free zones in relation to the outer layer, each of these free zones forming a protective zone. This single yoke, for example, could thus extend over the entire sleeve of the suit, as well as on a portion of the bust, could include free zones in the area of the shoulder, elbow and wrist, and could be fixed to the outer layer in the area of its ends, as well as in the area of the arm and of the forearm. This yoke could even entirely cover the inner surface of the suit to form a full lining. In the area of the parts of the user's body to be protected, this lining would have free protective zones; in the other, less sensitive parts, this lining would be fixed to the outer layer and would keep the role of providing comfort due to the texture of its material.

The invention is not limited to the particular embodiments described and shown. In particular, this improvement applies to garments that can be made of different materials than those described hereinabove and can be made of more complex assemblies. It applies as soon as irritations/frictions are perceptible by the athlete in the zones of his body in relative movements.

What is claimed is:

1. An aquatic sports garment comprising:

an outer layer comprising neoprene, the neoprene outer layer having a thickness and an elasticity;

at least one multi-layered zone comprising at least the outer layer, the multi-layered zone further comprising an underlying layer made of an elastic material comprising stretch fibers;

the underlying layer having a thickness less than the thickness of the outer layer;

the underlying layer having an elasticity greater than the elasticity of the outer layer;

in at least one protective zone, adapted to be arranged opposite at least one joint of a wearer of the garment, the underlying layer lines the skin of the wearer in an elastically deformable manner so as to protect the skin from contact with the outer layer;

the underlying layer comprising a fixing zone, the underlying layer being fixed directly or indirectly to the outer layer in the fixing zone and, at least in the protective zone, the outer layer and underlying layer being free from one another.

2. A garment according to claim 1, wherein the underlying layer is fixed directly on an inner surface of the outer layer.

3. A garment according to claim 1, wherein the underlying layer is fixed on an intermediary piece inserted between the underlying layer and the outer layer.

4. A garment according to claim 1, wherein the underlying layer is in the form of a yoke, and wherein the fixing zone is arranged on edges of the yoke.

5. A garment according to claim 1, wherein the at least one protective zone of the underlying layer is arranged opposite one or more of the following joints of the wearer; elbows, knees, shoulders, crotch.

6. A garment according to claim 1, wherein the underlying layer has characteristics of comfort.

7. An aquatic sports garment comprising:

an outer layer;

at least one multi-layered zone comprising at least the outer layer, the multi-layered zone further comprising an underlying layer made of an elastic material;

in at least one protective zone, adapted to be arranged opposite at least one joint of a wearer of the garment, the underlying layer lines the skin of the wearer in an elastically deformable manner so as to protect the skin from contact with the outer layer;

the underlying layer comprising a fixing zone, the underlying layer being fixed directly or indirectly to the outer layer in the fixing zone and, at least in the protective zone, the outer layer and underlying layer being free from one another;

the underlying layer comprising a perimeter forming the fixing zone for fixing said underlying layer on the outer layer, said perimeter of the underlying layer being substantially identical to a perimeter of the outer layer demarcating a bending zone, the bending zone comprising a development surface of the outer layer, said development surface of the outer layer being larger than a development surface of the protective zone of the underlying layer, so as to create a looseness of the outer layer with respect to the underlying layer to facilitate movement while eliminating constraints on the skin of the wearer.

8. A garment according to claim 1, wherein the underlying layer is made of a thin, elastic and non-folding material, so that the underlying layer lays flat against the skin of the wearer in order to protect the skin when the garment is worn by the wearer and to accompany all of movements of the wearer.

9. A garment according to claim 4, wherein the constituent material of the yoke comprises elasthane fibers.

10. A garment according to claim 1, wherein the underlying layer is fixed on the outer layer by having been heat-sealed onto the outer layer.

11. A garment according to claim 1, wherein the outer layer has characteristics of strength, insulation and watertightness.

12. A garment according to claim 1, wherein the constituent material of the outer layer is jersey associated with the neoprene.

13. A garment according to claim 1, wherein the outer layer comprises functional folds in the protective zone made by having been thermoformed, said functional folds facilitating movement of the outer layer relative to the underlying layer during movement by the wearer by a spreading of said functional folds during said movement of the outer layer.

14. A garment according to claim 1, wherein both the outer layer and the underlying layer extend throughout said at least one protective zone.

15. A garment according to claim 14, wherein the outer layer is movable relative to the underlying layer throughout said protective zone.

16. A garment according to claim 1, wherein both the outer layer and the underlying layer, in each of said at least one protective zone, extend throughout said at least one protective zone.

17. A garment according to claim 16, wherein, throughout each of said at least one protective zone, the outer layer is movable relative to the underlying layer.

18. A garment according to claim 1, wherein the underlying layer is fixed on the outer layer by at least one heat seal.

19. A garment according to claim 1, wherein the outer layer comprises functional folds lying above the underlying layer, the underlying layer adapted to lie flat against the skin of the wearer.

20. A garment according to claim 1, wherein the underlying layer comprises elasthane fibers.

21. A garment according to claim 1, wherein the neoprene of the outer layer comprises a neoprene layer having a thickness of about 3 millimeters to about 8 millimeters.

22. A garment according to claim 1, wherein the outer layer extends throughout areas of the garment beyond the underlying layer.

23. A garment according to claim 1, wherein the underlying layer has a periphery localized at said protective zone, the underlying layer being fixed to said outer layer at said periphery of the underlying area, said fixing zone comprising said periphery.

24. A garment according to claim 1, wherein the underlying layer comprises a tubular single sleeve having a two end edges, a first of said end edges of the tubular single sleeve adapted to extend around an arm of the wearer and being fixed to the outer layer, a second of said end edges of the tubular single sleeve being fixed to a torso portion of the outer layer.

25. A garment according to claim 1, wherein each of the at least one protective zone is arranged to be opposite a respectively different joint of the wearer of the garment.

26. A garment according to claim 25, wherein each of the at least one protective zone comprises a single free zone by which the underlying layer is non-attached to the outer layer.

27. A garment according to claim 1, wherein the protective zone has a size and shape adapted to cover a substantial area of the joint of a wearer of the garment.

28. A garment according to claim 7, wherein:

the outer layer comprises neoprene, the outer layer having a thickness and an elasticity;

the multi-layered zone comprises at least the outer layer, the multi-layered zone further comprising an underlying layer made of an elastic material comprising stretch fibers;

the underlying layer has a thickness less than the thickness of the outer layer;

the underlying layer has an elasticity greater than the elasticity of the outer layer.

29. A garment according to claim 28, wherein each of the at least one protective zone is arranged to be opposite a respectively different joint of the wearer of the garment.

30. A garment according to claim 29, wherein each of the at least one protective zone comprises a single free zone by which the underlying layer is non-attached to the outer layer.

31. A garment according to claim 7, wherein the protective zone of said one multi-layered zone comprises a single free zone by which the underlying layer is non-attached to the outer layer.

32. An aquatic sports garment comprising:

a plurality of discrete spaced-apart multi-layered zones, each of said plurality of multi-layered zones being localized to cover a different respective protective zone of a plurality of protective zones of a wearer of the garment;

each of said plurality of multi-layered zones comprising:

an outer layer comprising neoprene, said outer layer having a thickness and an elasticity;

an underlying layer comprising elastic fibers adapted to contact the skin of the wearer;

the underlying layer having a thickness less than the thickness of the outer layer;

the underlying layer having an elasticity greater than the elasticity of the outer layer;

the underlying layer having a peripheral fixing zone, the underlying layer being fixed relative to the outer layer in the fixing zone;

in the different respective protective zones, the underlying layers of the plurality of multi-layered zones being non-attached to the outer layers of the multi-layered zones to allow free movement therebetween.

33. A garment according to claim 32, wherein the neoprene of the outer layer comprises a neoprene layer having a thickness of about 3 millimeters to about 8 millimeters.

34. A garment according to claim 33, wherein the outer layer further comprises a woven jersey material covering the neoprene layer.

35. A garment according to claim 32, wherein the protective zone of each of said multi-layered zones comprises a single free zone by which the underlying layer is non-attached to the outer layer.

36. A garment according to claim 32, wherein the outer layer extends throughout areas of the garment beyond the underlying layer.

* * * * *